US012180729B2

(12) United States Patent
Wang et al.

(10) Patent No.: US 12,180,729 B2
(45) Date of Patent: Dec. 31, 2024

(54) FREELY MOVABLE CONSTRUCTION PLATFORM

(71) Applicants: HAINAN UNIVERSITY, Haikou (CN); CHINA NATIONAL CHEMICAL ENGINEERING NO. 13 CONSTRUCTION CO., LTD, Cangzhou (CN)

(72) Inventors: Yongwei Wang, Haikou (CN); Qinxi Dong, Haikou (CN); Qunwei Wang, Cangzhou (CN)

(73) Assignees: Hainan University, Haikou (CN); China National Chemical Engineering No. 13 Construction Co., Ltd., Cangzhou (CN)

( * ) Notice: Subject to any disclaimer, the term of this patent is extended or adjusted under 35 U.S.C. 154(b) by 0 days.

(21) Appl. No.: 18/670,668

(22) Filed: May 21, 2024

(65) Prior Publication Data

US 2024/0392586 A1 Nov. 28, 2024

(30) Foreign Application Priority Data

May 25, 2023 (CN) ..... 202310600653.2

(51) Int. Cl.
*E04G 3/28* (2006.01)

(52) U.S. Cl.
CPC ..... *E04G 3/28* (2013.01); *E04G 2003/286* (2013.01)

(58) Field of Classification Search
CPC .. E04G 3/28; E04G 3/30; E04G 3/305; E04G 3/32; E04G 2003/286; F03D 80/50; F03D 80/501
See application file for complete search history.

(56) References Cited

U.S. PATENT DOCUMENTS 3,220,509 A * 11/1965 Fisher ..... E04G 3/243 182/47
3,931,868 A * 1/1976 Smith, Jr. ..... A62B 1/02 244/137.1

(Continued)

FOREIGN PATENT DOCUMENTS

CN 105952135 A 9/2016
CN 110271998 A 9/2019

(Continued)

*Primary Examiner* — Colleen M Chavchavadze
(74) *Attorney, Agent, or Firm* — AP3 Law Firm PLLC

(57) ABSTRACT

A construction platform that is freely movable up and down is provided, which includes several curved platforms, several columns and a control panel. The curved platforms are connected with one after the other to form a ring-shaped platform that surrounds a cylindrical building and is movable along the columns. Each curved platform is provided with one or more mounting brackets. Each mounting bracket is provided with one or more movable brackets, one or more pressing mechanisms, one or more locking mechanisms, one or more movable rods, one or more suction cups, a pumping mechanism, and one or more emergency braking mechanisms. Each emergency braking mechanism includes a sprocket, a chain, a counterweight, an angle sensor, and a configuring assembly. Each configuring assembly includes a ring gear, a mounting sleeve, a configuring rod, a pawl, a torsion spring, an electromagnet and a magnetic block.

6 Claims, 6 Drawing Sheets

(56) References Cited

U.S. PATENT DOCUMENTS

| | | | | |
|---|---|---|---|---|
| 4,257,491 | A * | 3/1981 | Presnall, Jr. | E04G 3/243 182/187 |
| 4,355,699 | A * | 10/1982 | Smith, Jr. | A62B 1/02 182/12 |
| 4,865,155 | A * | 9/1989 | Montaigne | B66B 9/022 182/36 |
| 5,791,862 | A * | 8/1998 | Ohtsuki | E04G 3/34 15/103 |
| 10,213,801 | B2 * | 2/2019 | Lim | B05B 13/005 |
| 11,135,611 | B2 * | 10/2021 | Lim | B25J 11/0085 |
| 11,655,640 | B2 * | 5/2023 | Abadia Perez | E04G 3/28 182/36 |
| 2007/0205405 | A1 | 9/2007 | Stockmaster et al. | |
| 2014/0054110 | A1 * | 2/2014 | Fernandez | E04G 3/30 182/19 |
| 2018/0355625 | A1 * | 12/2018 | Takagi | E04G 3/325 |
| 2022/0251858 | A1 * | 8/2022 | Montaner Fraguet | B66C 23/32 |

FOREIGN PATENT DOCUMENTS

| | | | |
|---|---|---|---|
| CN | 112252197 | A | 1/2021 |
| CN | 112761187 | A | 5/2021 |
| CN | 113944363 | A | 1/2022 |
| CN | 114809594 | A | 7/2022 |

* cited by examiner

FREELY MOVABLE CONSTRUCTION PLATFORM

CROSS-REFERENCE TO RELATED APPLICATION

This application claims priority to Chinese Patent Application No. CN 202310600653.2, filed on May 25, 2023 and entitled "freely movable construction platform". The disclosure of the aforementioned application is hereby incorporated herein by reference in its entirety.

TECHNICAL FIELD

The present disclosure relates to the technical field of construction auxiliary device and, more specifically, to a freely movable construction platform.

BACKGROUND

Industry chimneys, as industry structures, are constructed in large quantities. The construction work of an industry chimney has much difficulty, which needs high technologies and is high-risk work. If there is any slight omission in the construction process, it is very easy to cause safety accidents, resulting in property damage and bad social impact. Scaffold is a common construction platform for constructing an industry chimney. However, a large quantity of scaffolding poles, such as steel tubes, is needed for erecting a scaffold. The operations of assembling and disassembling couplers, such as scaffolding fasteners, are burdensome, time-consuming and laborious. The erecting of a scaffold is inefficiency and high-risky. To solve the problem of how to raise and lower a construction platform, CN105839906A discloses a lifting platform for outer wall decoration, which realizes the raising and lowering of the lifting platform along a track by pulling with a sling. A person on the lifting platform can operate the controller, according to the needs of decoration, to control the position device to drive the lifting platform to move to a position with desired height, therefore, there is no need for the person to climb up and down. However, a lifting equipment that is above the lifting platform and is generally in a very high position is needed, resulting in that working at height which is risky is mandatory. In addition, once installed, the lifting platform is difficult to move and only the wall in one side of a building is available for people to work on; and for the walls of other sides, the lifting platform is needed to be moved to there, which is very difficult and burdensome. And, the lifting platform is provided without a drop-proof structure, therefore, there is a risk of accidental dropping. The safety performance of the lifting platform needs to be improved.

SUMMARY

These and other problems are generally solved or circumvented, and technical advantages are generally achieved, by embodiments of the present disclosure which provides a freely movable construction platform.

TECHNICAL PROBLEMS

The present disclosure provides a freely movable construction platform to solve the problems mentioned above.

TECHNICAL SOLUTIONS

The present disclosure provides a construction platform that can freely move up and down. The construction platform may include a plurality of curved platforms, a plurality of columns and a control panel arranged on one of the curved platforms. The columns are configured to be distributed in a manner of surrounding a cylindrical building. The curved platforms are connected to and movable along the columns. The curved platforms are connected to one after the other to form a ring-shaped platform that surrounds the cylindrical building and is movable along the lengths of the columns.

Each curved platform is provided with one or more mounting brackets, and each mounting bracket is provided with one or more movable brackets, one or more pressing mechanisms, one or more locking mechanisms, one or more movable rods, one or more suction cups, a pumping mechanism, and one or more emergency braking mechanisms.

Each movable bracket is provided with one or more drive wheels and a motor, and the motor is configured to drive the drive wheels. The drive wheels are configured to be pressed on the side wall of the cylindrical building such that they can drive (using friction) the ring-shaped platform formed by the curved platforms to move up and down relative to the cylindrical building.

The pressing mechanisms are electrically connected with the control panel. The pressing mechanisms may correspond one-to-one to the movable brackets. Each pressing mechanism is configured to drive a corresponding movable bracket of the movable brackets to move towards the cylindrical building, such that the drive wheels that are arranged on the corresponding movable bracket can be pressed on the side wall of the cylindrical building. When the drive wheels are pressed on the side wall of the cylindrical building, they can drive the ring-shaped platform formed by the curved platforms to move up and down.

The locking mechanisms are configured to lock the ring-shaped platform formed by the curved platforms to a work position with a preset height. The locking mechanisms can lock the mounting bracket, on which the locking mechanisms are arranged, to the cylindrical building. The locking mechanisms are electrically connected with the control panel, such that people can control the ring-shaped platform formed by the curved platforms to be locked after it moves to one of desired work positions.

The movable rods, the suction cups, the pumping mechanism and the emergency braking mechanisms are configured to work together to realize the emergency braking of the ring-shaped platform formed by the curved platforms when it is in an abnormal falling state.

The movable rods are movably arranged on each mounting bracket. The first end of each movable rod may be provided with one of the suction cups. Each movable rod is sleeved with a first spring which is configured to drive, by its elasticity, the movable rod to move towards the cylindrical building, such that the suction cup arranged on the first end of the movable rod can move towards and close to the side wall of the cylindrical building, thus the suction cup can finally contact the side wall of the cylindrical building.

The pumping mechanism is in communication with the suction cup and is configured to, when the suction cup contacts the side wall of the cylindrical building, pump air between the suction cup and the side wall of the cylindrical building, such that a vacuum cavity can be formed between the suction cup and the side wall of the cylindrical building, resulting in that the suction cup sucks and holds on the cylindrical building. Using the suction cups, the ring-shaped platform formed by the curved platforms can hold on the cylindrical building and realize its emergency braking.

The emergency braking mechanisms may correspond one-to-one to the movable rods and each emergency braking mechanism may include a sprocket, a chain, a counterweight, an angle sensor, and a configuring assembly. When the ring-shaped platform formed by the curved platforms is in an abnormal falling state, the emergency braking mechanisms can, using the inertia of the counterweights, detect the abnormal falling and let the suction cups suck on the cylindrical building to realize the emergency braking of the ring-shaped platform.

The sprocket is arranged on each mounting bracket. The chain matches the sprocket. The first end of the chain is connected with the second end of a corresponding movable rod of the movable rods, and the second end of the chain is connected with the counterweight which is configured to detect whether the ring-shaped platform formed by the curved platforms is in a normal state or in the abnormal falling state.

When the ring-shaped platform formed by the curved platforms is in the normal state, each counterweight pulls the chain to drive, by the gravity of the counterweight, the corresponding movable rod and the suction cup that is arranged on the corresponding movable rod to move away from the cylindrical building.

When the ring-shaped platform formed by the curved platforms is in the abnormal falling state, under the action of inertia of the counterweight, the counterweight won't fall immediately. Thus, the counterweight moves upward relative to each mounting bracket and the counterweight no longer pulls the chain, such that the suction cup arranged on the corresponding movable rod will be pressed by the first spring sleeved on the corresponding movable rod to move towards and contact the side wall of the cylindrical building to form the vacuum cavity between the suction cup and the side wall of the cylindrical building.

The angle sensor is electrically connected with the control panel. The angle sensor is also connected with the sprocket. The angle sensor is configured to detect the rotating direction and the rotating angle of the sprocket. When the ring-shaped platform formed by the curved platforms is in the abnormal falling state, the sprocket will rotate sharply. The angle sensor can detect the abnormal falling state through the sharp rotation of the sprocket.

The configuring assembly is used for configuring/limiting the rotating direction of the sprocket. That is, when the ring-shaped platform formed by the curved platforms is in the normal state, the configuring assembly let the sprocket be rotatable freely in both direction; and when the ring-shaped platform formed by the curved platforms is in the abnormal falling state, the configuring assembly make the sprocket only be rotatable in the direction that leads the corresponding movable rod and the suction cup arranged on the corresponding movable rod to move towards and close to the side wall of the cylindrical building.

Each configuring assembly may include a ring gear, a mounting sleeve, a configuring rod, a pawl, a torsion spring, an electromagnet and a magnetic block. The ring gear is fixedly arranged on the sprocket and is coaxial with the sprocket. The mounting sleeve is arranged on each mounting bracket. The configuring rod is movably arranged in the mounting sleeve and is sleeved with a second spring. The first end of the configuring rod is provided with a plate which can be pressed by the second spring. Both the plate and the second spring are arranged in the mounting sleeve. The second spring is connected to the mounting sleeve, and the first end of the second spring is configured to contact and press the plate.

The pawl is arranged on the second end of the configuring rod and is configured to unidirectionally swing. The torsion spring is connected between the pawl and the second end of the configuring rod. The torsion spring is configured to cause the pawl to reset to a position at which the pawl is insertable between two teeth of the ring gear.

The electromagnet is arranged on the mounting sleeve and is electrically connected with the control panel. The magnetic block is arranged on the configuring rod and is adjacent to the electromagnet, such that when the electromagnet is activated, it can repel/drive the magnetic block and the configuring rod to move towards the ring gear.

When the ring-shaped platform formed by the curved platforms is in the normal state, the second spring sleeved on the configuring rod presses the plate arranged on the first end of the configuring rod to drive the configuring rod and the pawl arranged on the second end of the configuring rod to move away from the ring gear, such that the rotating direction of the sprocket is not limited.

When the ring-shaped platform formed by the curved platforms is in the abnormal falling state, the electromagnet is activated to repel the magnetic block, such that the configuring rod and the pawl are driven to move towards the ring gear, the pawl enters between two teeth of the ring gear, and the sprocket is prevented from rotating in a direction that leads the corresponding movable rod and the suction cup that is arranged on the corresponding movable rod to move away from the cylindrical building. The pawl can only swing in one direction, thus when it enters and engage with two teeth of the ring gear, the ring gear and the sprocket can only rotate in one direction.

ADVANTAGEOUS EFFECTS OF THE DISCLOSURE

The advantageous effects of the construction platform are as follows:

The construction platform includes curved platforms which are connected to one after the other to form a ring-shaped platform which surrounds the cylindrical building. Thus, for people on the ring-shaped platform formed by the curved platforms, any side wall of the cylindrical building is available. Therefore, there is no need to move the construction platform among different sides of a building (e.g., the cylindrical building), which facilitates the construction process of the building and shorten the construction period. In addition, the ring-shaped platform formed by the curved platforms can move freely along the height direction of the building. Therefore, not only any side is available, but also any height of the building is available. That is, any point of the side wall(s) of the building is available. This ensures that the construction process of the building can be performed successfully.

The construction platform is provided with emergency braking mechanisms and suction cups. When the ring-shaped platform formed by the curved platforms is in the abnormal falling state, through the acting of the emergency braking mechanisms, the suction cups can suck the side wall of the cylindrical building to stop the ring-shaped platform formed by the curved platforms from falling. Therefore, the safety accidents caused by the unexpected falling of the ring-shaped platform formed by the curved platforms can be avoided. The safety performance of the construction platform provided by the present disclosure is good. In the process of the normal moving of the ring-shaped platform formed by the curved platforms, the emergency braking mechanisms won't act and the suction cups won't contact and suck the cylindrical building.

The emergency braking mechanisms are provided with configuring assemblies. When the ring-shaped platform formed by the curved platforms is in the abnormal falling state, configuring assemblies make the sprockets of the emergency braking mechanisms can only rotate in the direction that leads the suction cups to move towards the cylindrical building. The sprockets are prevented from rotating in the direction that leads the suction cups to move away from the cylindrical building, such that the ring-shaped platform formed by the curved platforms won't fall again once stopped in the emergency braking state. This ensures that the emergency braking of the ring-shaped platform can be successfully realized. In the normal state, the sprockets are not limited by the configuring assemblies.

BRIEF DESCRIPTION OF THE DRAWINGS

In order to more clearly illustrate the technical solutions in the embodiments of the present disclosure, the accompanying drawings to be used in the descriptions of the embodiments or the prior art will be briefly described below. Obviously, the accompanying drawings in the following description are only some embodiments of the present disclosure, and for a person of ordinary skill in the art, without involving any inventive effort, other accompanying drawings may also be obtained according to these accompanying drawings.

Corresponding numerals and symbols in the different figures generally refer to corresponding parts unless otherwise indicated. The figures are drawn to clearly illustrate the relevant aspects of the various embodiments and are not necessarily drawn to scale.

DETAILED DESCRIPTION OF ILLUSTRATIVE EMBODIMENTS

Figure 1:
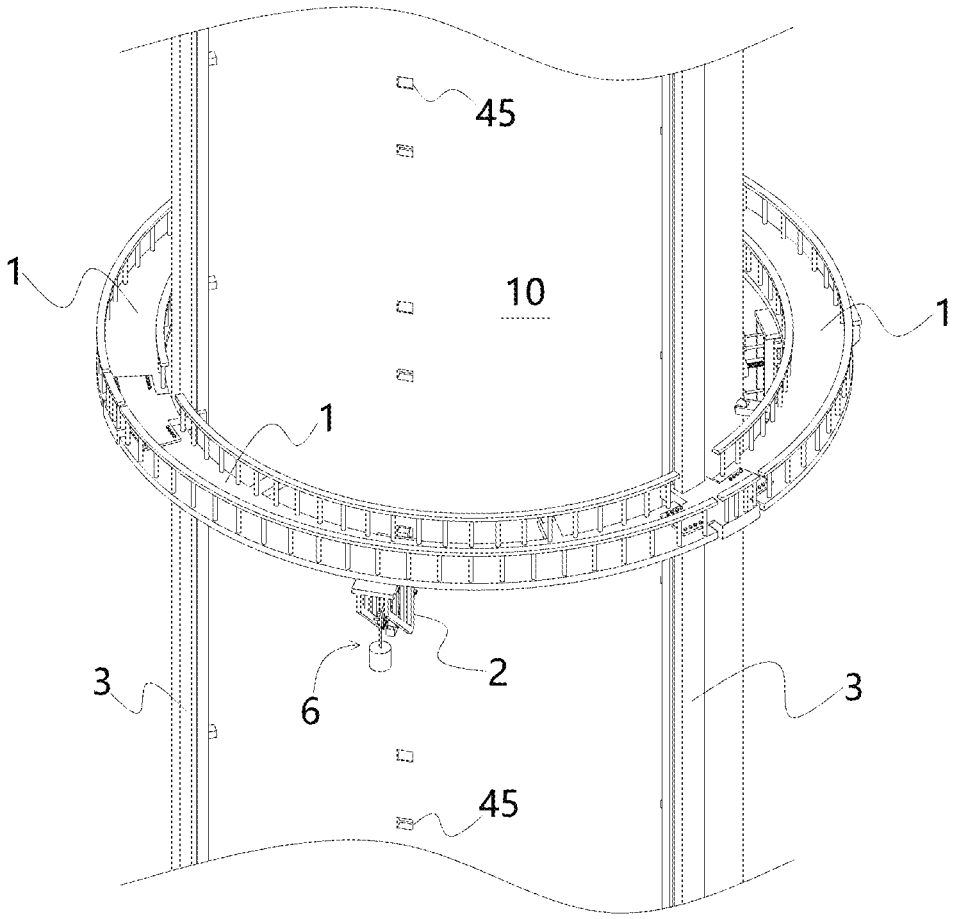
FIG. 1 is a schematic perspective view of a freely movable construction platform surrounding a cylindrical building according to embodiments of the present disclosure.

Specific embodiments of the present disclosure are described in detail below with the drawings. The drawings show some preferred embodiments, which are aimed to supplement the text description with graphics, so that people can intuitively and vividly understand any technical feature and the overall technical solution of the present disclosure. The drawings cannot be regarded as limitation of protection scope of the present disclosure.

Embodiment 1

Please referring to FIGS. 1 to 4, the freely movable construction platform provided by the present disclosure may include a plurality of curved platforms 1, a plurality of columns 3, a plurality of locking mechanisms 4, a plurality of suction cups 5, a plurality of emergency braking mechanisms 6, a plurality of pumping mechanisms 7 and a control panel that is generally arranged on any one of the curved platforms 1.

The columns 3 are configured to be distributed in a manner of surrounding a cylindrical building 10. The curved platforms 1 are connected to and movable along the columns 3.

The curved platforms 1 are connected with one after the other to form a ring-shaped platform that surrounds the cylindrical building 10 and movable along the height direction of the columns 3. Each curved platform 1 is provided with one or more mounting brackets 2 that are generally under each curved platform 1. Each mounting bracket 2 is provided with one or more movable brackets 21 and one or more pressing mechanisms 22. The movable brackets 21 are movably arranged on each mounting bracket 2. Each movable bracket 21 is provided with one or more drive wheels 23 that are driven by a motor which may be arranged on each movable bracket 21. The pressing mechanisms 22 are configured to drive the movable brackets 21 to move towards the cylindrical building, such that the drive wheels 23 that are arranged on the movable brackets 21 can press on the side wall of the cylindrical building 10. The pressing mechanisms 22 correspond one-to-one to the movable brackets 21. When a movable bracket 21 is driven by the corresponding pressing mechanism 22, the drive wheels 23 arranged on the movable bracket 21 can tightly press the side wall of the cylindrical building 10, such that the friction between the driven wheels 23 and the side wall of the cylindrical building 10 can drive the curved platforms 1 to move up and down along the height direction of the columns 3 and the cylindrical building 10. The pressing mechanisms 22 are electrically connected with the control panel, therefore, people can control, by operating the control panel, the pressing mechanisms 22 to drive the movable brackets 21 to move towards or away from the cylindrical building 10. The motors for driving the drive wheels 23 to rotate are also electrically connected with the control panel, such that the drive wheels 23 can be controlled to rotate or not.

The locking mechanisms 4 are arranged on the mounting brackets 2 and each mounting bracket 2 may be provided with one or more locking mechanisms 4. The locking mechanisms 4 are configured to lock each mounting bracket 2 to the cylindrical building 10, such that each curved platform 1 can be positioned at a desired heigh of the cylindrical building 10. When all curved platforms 1 are positioned, the ring-shaped platform that is made up by the curved platforms 1 is positioned. The locking mechanisms 4 are electrically connected with the control panel, therefore, people can control, by operating the control panel, the locking mechanisms 4 to lock the mounting brackets 2 or not.

The suction cups 5, the emergency braking mechanisms 6, and the pumping mechanisms 7 are arranged on the mounting brackets 2. Each mounting bracket 2 may be provided with one or more suction cups 5, one or more emergency braking mechanisms 6 and a pumping mechanism 7. The suction cups 5 are movably arranged on each mounting bracket 2, such that they may move towards and contact the side wall of the cylindrical building or not. The pumping mechanism 7 is in communication with the suction cups 5 and is configured to, when the suction cups 5 contact the side wall of the cylindrical building 10, pump air between the suction cups 5 and the side wall of the cylindrical building 10, such that vacuum cavities can be formed between the suction cups 5 and the side wall of the cylindrical building 10, resulting in that the suction cups 5 can suck and hold on the cylindrical building 10.

The emergency braking mechanisms 6 are arranged on each mounting bracket 2 and are configured to detect whether the ring-shaped platform formed by the curved platforms 1 is in a normal state or in an abnormal falling state. When the ring-shaped platform is in the abnormal falling state, emergency braking mechanisms 6 can detect the sudden falling of the ring-shaped platform and let the suction cups 5 can move towards and contact the side wall of the cylindrical building 10. The emergency braking mechanisms 6 are electrically connected with the control panel.

In the present embodiment, the plurality of curved platforms 1 are connected to one after the other, therefore, the ring-shaped platform is formed. The ring-shaped platform can surround a building, therefore, all sides of the building (e.g., four sides of a cylindrical building with a square section) are available, and there is no need to move the construction platform among different sides of the building, which facilitates the construction process of the building and shorten the construction period.

In addition, the ring-shaped platform formed by the curved platforms 1 can freely move up and down along the cylindrical building 10 and be positioned at any desired height, thus the work at any height can be performed. The ring-shaped platform formed by the curved platforms 1 can be positioned by the locking mechanisms 4 that are arranged on the mounting brackets 2. When needed to move to another height, the ring-shaped platform formed by the curved platforms 1 will be released by the locking mechanisms 4, and the drive wheels 23 arranged on the movable brackets 21 will be pressed on the side wall of the cylindrical building 10, such that the ring-shaped platform formed by the curved platforms 1 can be driven by the drive wheels 23 to move up or down. Anytime, once the ring-shaped platform formed by the curved platforms 1 falls suddenly/unexpectedly, the emergency braking mechanisms 6 and the pumping mechanisms 7 will act, and the suction cups 5 will suck and hold on the cylindrical building 10 to prevent the ring-shaped platform formed by the curved platforms 1 from falling and realize emergency braking. Therefore, the safety accidents caused by the falling of the ring-shaped platform formed by the curved platforms 1 can be avoided and the safety performance of the construction platform provided by the present disclosure is good.

Exemplary, considering the side wall of the cylindrical building 10 may be rough, the suction cups 5 may be vacuum suction units in the prior art which are based on zero pressure difference (ZPD) method. The ZPD method eliminates pressure difference at the boundary of the vacuum zone of a vacuum suction unit, therefore vacuum leakage can be prevented regardless of the roughness of the working surface (e.g., the side wall of the cylindrical building 10). The ZPD suction unit forms a rotating water layer on the periphery of the vacuum zone, and the resulting inertial force generates a steep pressure gradient so that a high vacuum is maintained at the center of the vacuum zone while the pressure at the boundary remains equal to the atmospheric pressure. Therefore, even though the side wall of the cylindrical building 10 is rough, the suction cups 5 can provide enough suction power to hold the ring-shaped platform formed by the curved platforms 1 on the cylindrical building 10. In addition, to ensure that the suction cups 5 can provide enough suction power, the number of the suction cups 5 can be selected according to the size and weight of the ring-shaped platform formed by the curved platforms 1.

Exemplary, the suction cups 5 also may be suction units based on principles of biomimicry, which mimic a gecko climbing a wall.

Exemplary, to ensure that the drive wheels 23 can provide enough drive power to drive the ring-shaped platform formed by the curved platforms 1 moving up and down, the following parameters can be selected according to the size and weight of the ring-shaped platform formed by the curved platforms 1: the number of the drive wheels 23, the magnitude of the pressure generated by each pressing mechanism 22 to press the drive wheels 23 on the side wall of the cylindrical building 10, and the material of the drive wheels 23 which affects the amount of friction between the drive wheels 23 and the side wall of the cylindrical building 10. Each motor for driving the drive wheels 23 to rotate may be connected with the drive wheels 23 by a worm-gear structure.

Figure 2:
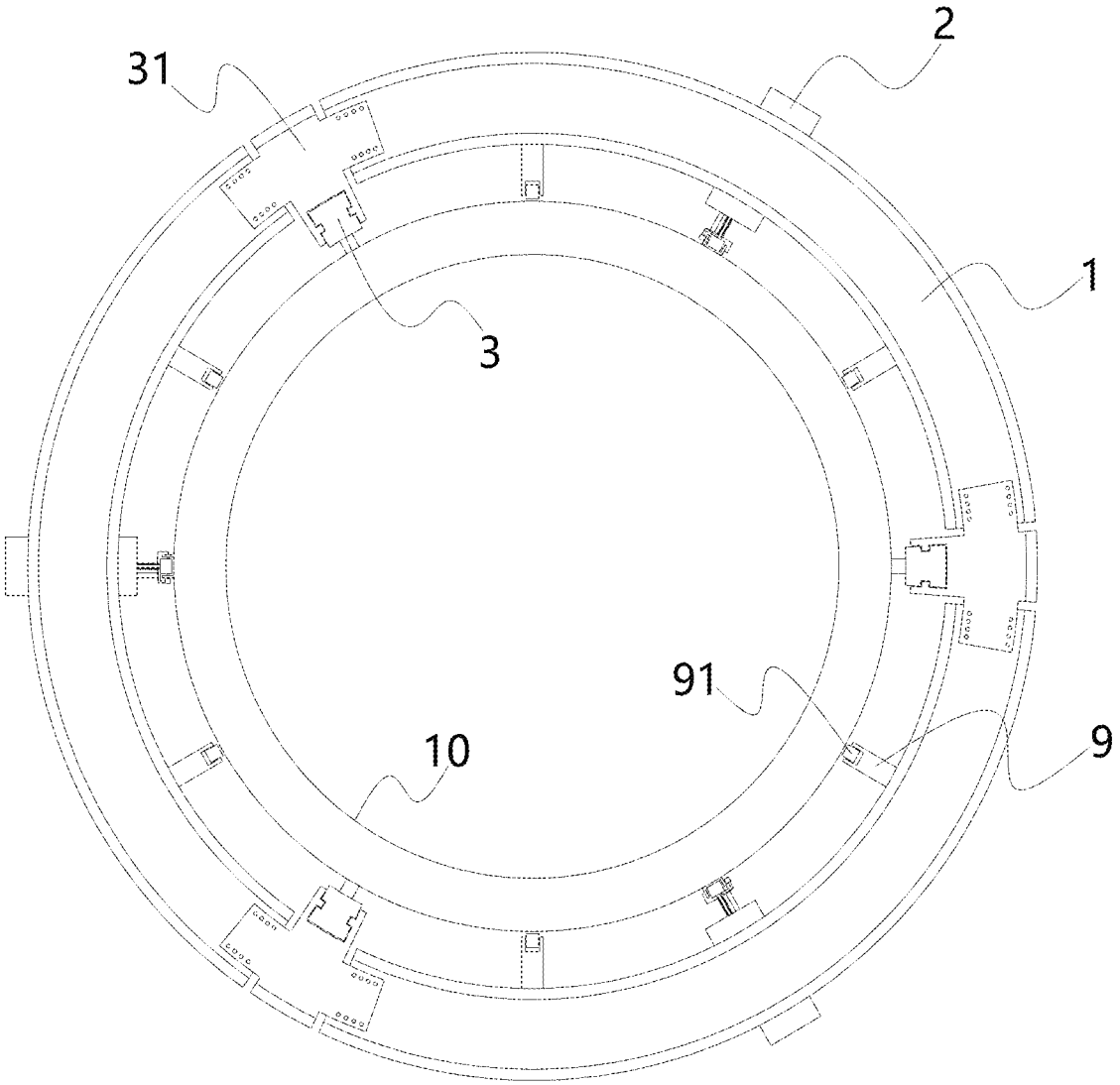
FIG. 2 is a schematic top view of a freely movable construction platform surrounding a cylindrical building according to embodiments of the present disclosure.

Exemplary, the structures for connecting the curved platforms 1 and the columns 3 may be existing structures in the prior art, for example, gear mechanism, sprocket and chain, rolling connection, etc. As shown in FIG. 2, connecting structures 31 may be provided. Each connecting structure 31 is fixedly connected, respectively, with two curved platforms 1 which are adjacent to the connecting structure 31. In addition, each connecting structure 31 may be movably connected with one of the columns 3. In FIG. 2, the number of the connecting structures 31 and the columns 3 is three.

Exemplary, the control panel may be manufactured using the technologies in prior art. The control panel may be provided with a built-in control system including several STM32 microcontrollers.

Figure 3:
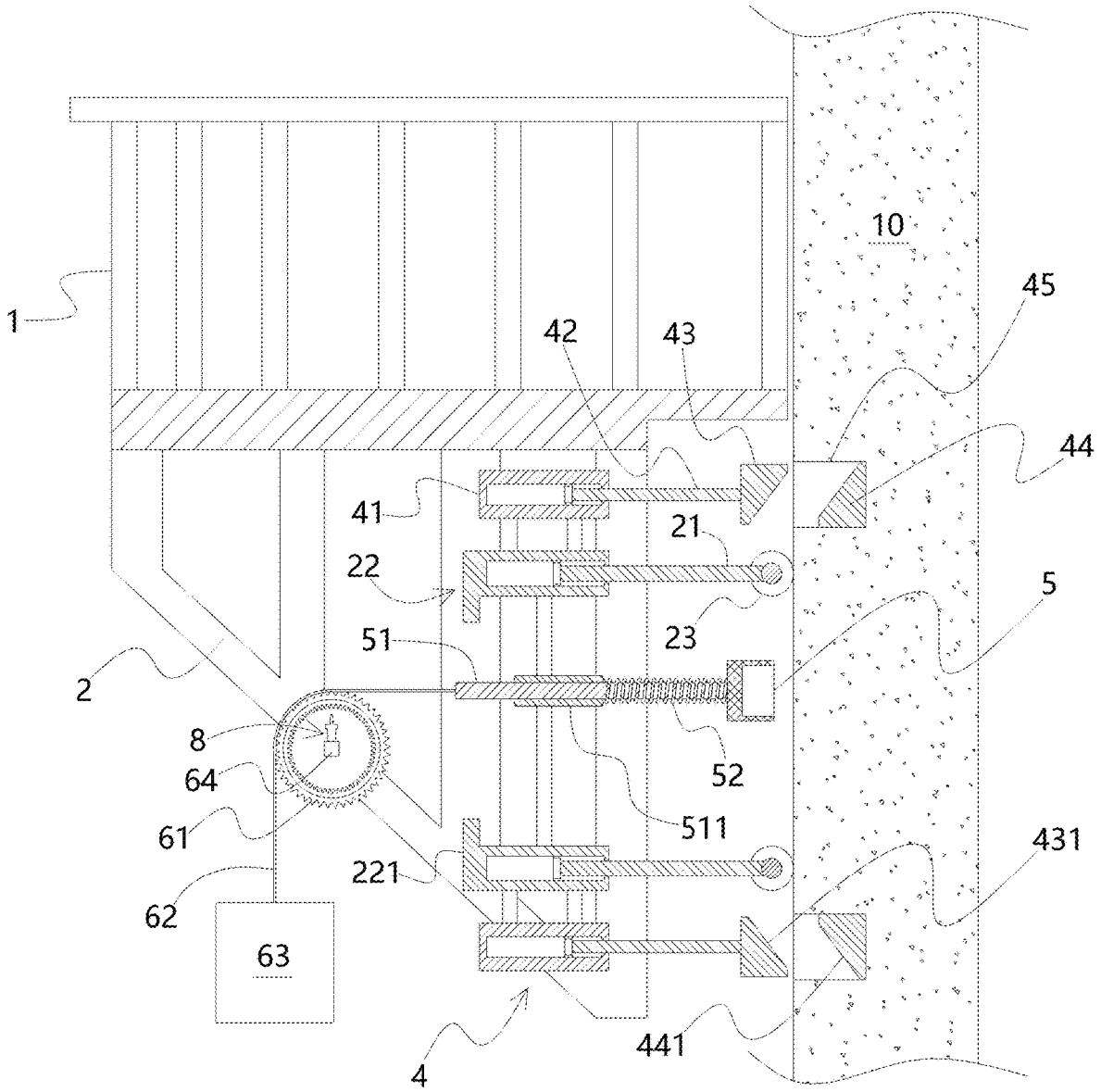
FIG. 3 is a schematic sectional view of a curved platform (and structures attached on it) of a freely movable construction platform according to embodiments of the present disclosure, where the curved platform is arranged adjacent to a cylindrical building, the section plane coincides with the centerline of the cylindrical building, and the symbols for section are only used for distinguishing different elements and is without any other meaning.

Exemplary, each suction cup 5 may be provided with one or more movable rods 51 which movably arranged on each mounting bracket 2. The suction cup 5 may be arranged on the first end of the movable rods 51. Each movable rod 51 is sleeved with a first spring 52 for pressing the suction cup 5 to move towards and contact the side wall of the cylindrical building 10. Each movable rod 51 may be arranged on the mounting bracket 2 through a sleeve 511, as shown in FIG. 3, which is fixedly connected with the mounting bracket 2. The movable rod 51 passes through the sleeve 511 and is movable along the length direction of the sleeve 511.

Exemplary, the emergency braking mechanisms 6 may correspond one-to-one to the movable rods 51 and each emergency braking mechanisms 6 may include a sprocket 61, a chain 62, a counterweight 63, a configuring assembly 8 and an angle sensor 64. The sprocket 61 is arranged on each mounting bracket 2 and it is rotatable. The chain 62 matches and engages with the sprocket 61. The first end of the chain 62 is connected with the second end of the movable rod 51 that corresponds to the emergency braking mechanism 6, and the second end (the hanging end) of the chain 62 is connected with the counterweight 63. In the normal state, the counterweight 63 overcomes the elasticity of the first spring 52 and pull the corresponding movable rod 51, to make the suction cup 5 arranged on the corresponding movable rod 51 move away from the cylindrical building 10. The configuring assembly 8 is generally arranged on each mounting bracket 2 and is used for configuring/limiting the rotating direction of the sprocket 61. The angle sensor 64 is electrically connected with the control panel. The angle sensor 64 is connected with the sprocket 61 and is configured to detect the rotating direction and the rotating angle of the sprocket 61.

The emergency braking mechanism 6 provided in this example uses the inertia of the counterweight 63 to detect whether the ring-shaped platform formed by the curved platforms 1 is in the normal state or in the abnormal falling state. When the ring-shaped platform is in the normal state, the acceleration amplitude of its start/stop process of moving up and down is small, and the sprockets 61 just rotates slightly. In this situation, the counterweights 63 can pull the movable rods 51 through the chains 62 to make the suction cups 5 arranged on the movable rods 51 move away from the cylindrical building 10. At this time, the first springs 52 sleeved on the movable rods 51 are in compression, and the ring-shaped platform formed by the curved platforms 1 can freely move up and down driven by the drive wheels 23.

When the ring-shaped platform formed by the curved platforms 1 is in the abnormal falling state, the ring-shaped platform goes down rapidly in a short period of time. However, the counterweights 63 won't goes down immediately due to their own inertia, resulting in that the counterweights 63 move upward relative to the ring-shaped platform and can no longer pull the movable rods 51. When the movable rods 51 are not pulled by the counterweights 63, the movable rods 51 move towards the cylindrical building 10 driven by the elasticity of the first springs 52, thus the suction cups 5 arranged on the movable rods 51 move towards and contact the side wall of the cylindrical building 10. In the process of the movable rods 51 moving towards the cylindrical building 10, the sprockets 61 rotate sharply (not slightly, generally, the angle of the sharp rotation may exceed 360 degrees) in a first direction (the clockwise direction in FIGS. 3 and 5). When the control panel detects the sharp rotation of the sprockets 61 through the angle sensors 64, the control panel control the pumping mechanisms 7 and the configuring assemblies 8 to work according to the rotating direction and the rotating angle of the sharp rotation of the sprockets 61. The pumping mechanisms 7 pump air between the suction cups 5 and the side wall of the cylindrical building 10 to form the vacuum cavities, thus the ring-shaped platform formed by the curved platforms can suck and hold on the cylindrical building 10 through the suction cups 5 and the emergency braking of the ring-shaped platform is realized. The configuring assemblies 8 act on the sprockets 61 to limit the rotating direction of the sprockets 61, such that the sprockets 61 can only rotate in the first direction. That is, in the process of emergency braking and after the emergency braking, the sprockets 61 cannot rotate in the counter direction of the first direction, thus the counterweights 63 cannot pull the movable rods 51 through the chains 62. Therefore, after the emergency braking (at this time, the ring-shaped platform formed by the curved platforms 1 has stopped falling), the suction cups 5 can keep contacting and sucking the side wall of the cylindrical building 10 to prevent the ring-shaped platform formed by the curved platforms 1 falling again.

When the emergency braking state needs to be dismissed and let the ring-shaped platform formed by the curved platforms 1 move normally, the pumping mechanisms 7 and the configuring assemblies 8 can be controlled through the control panel, such that the limitation on the rotating direction of the sprockets 61 is dismissed and the pumping mechanisms 7 supplies air to the vacuum cavities between the suction cups 5 and the side wall of the cylindrical building 10, resulting in that the suction cups 5 no long suck the side wall of the cylindrical building 10 and the counterweights 63 pull the suction cups 5 to move away from the cylindrical building 10 simultaneously the sprockets 61 rotates in the counter direction (the counter clockwise direction in FIGS. 3 and 5) of the first direction. At this time, the emergency braking state is dismissed, the first springs 52 sleeved on the corresponding movable rod 51 is in compression, and the ring-shaped platform formed by the curved platforms 1 can freely move up and down driven by the drive wheels 23.

Embodiment 2

Based on the Embodiment 1, the present embodiment provides structures of each configuring assembly 8. The embodiment 2 includes the structures of the Embodiment 1 and the configuring assembly 8. Please referring to FIGS. 5 and 6, in the present embodiment, each configuring assembly 8 may include a ring gear 81, a pawl 82, a configuring rod 83, a magnetic block 84, a second spring 85 and an electromagnet 86. The ring gear 81 is fixedly arranged on a sprocket 61 and is coaxial with the sprocket 61. The configuring rod 83 is movably arranged on a mounting bracket 2. The configuring rod 83 is arranged on the configuring rod 83 and is configured to unidirectionally swing. The second spring 85 is sleeved on the configuring rod 83 and is configured to reset the configuring rod 83, that is, to drive the configuring rod 83 and the pawl 82 arranged on it to move away from the ring gear 81. The magnetic block 84 is fixedly connected to the configuring rod 83 and the electromagnet 86 is arranged on the mounting bracket 2. The electromagnet 86 is electrically connected with the control panel. The electromagnet 86 is adjacent to the magnetic block 84. When the electromagnet 86 is activated, the electromagnet 86 and the magnetic block 84 repel each other, such that the electromagnet 86 can drive, through magnetism, the magnetic block 84 (as well as the configuring rod 83 and the pawl 82 connected with the magnetic block 84) to move towards and close to the ring gear 81, and the pawl 82 can enter between two teeth of the ring gear 81 to prevent the sprocket 61 from rotating in an undesired direction (the counterclockwise direction in FIG. 5). The pawl 82 is provided with a torsion spring 821 which is connected between the pawl 82 and the second end (the top end in FIGS. 5 and 6) of the configuring rod 83. The torsion spring 821 is configured to cause the pawl 82 to reset to a position (as shown in FIGS. 5 and 6) at which the pawl 82 is insertable between two teeth of the ring gear 81.

Figure 5:
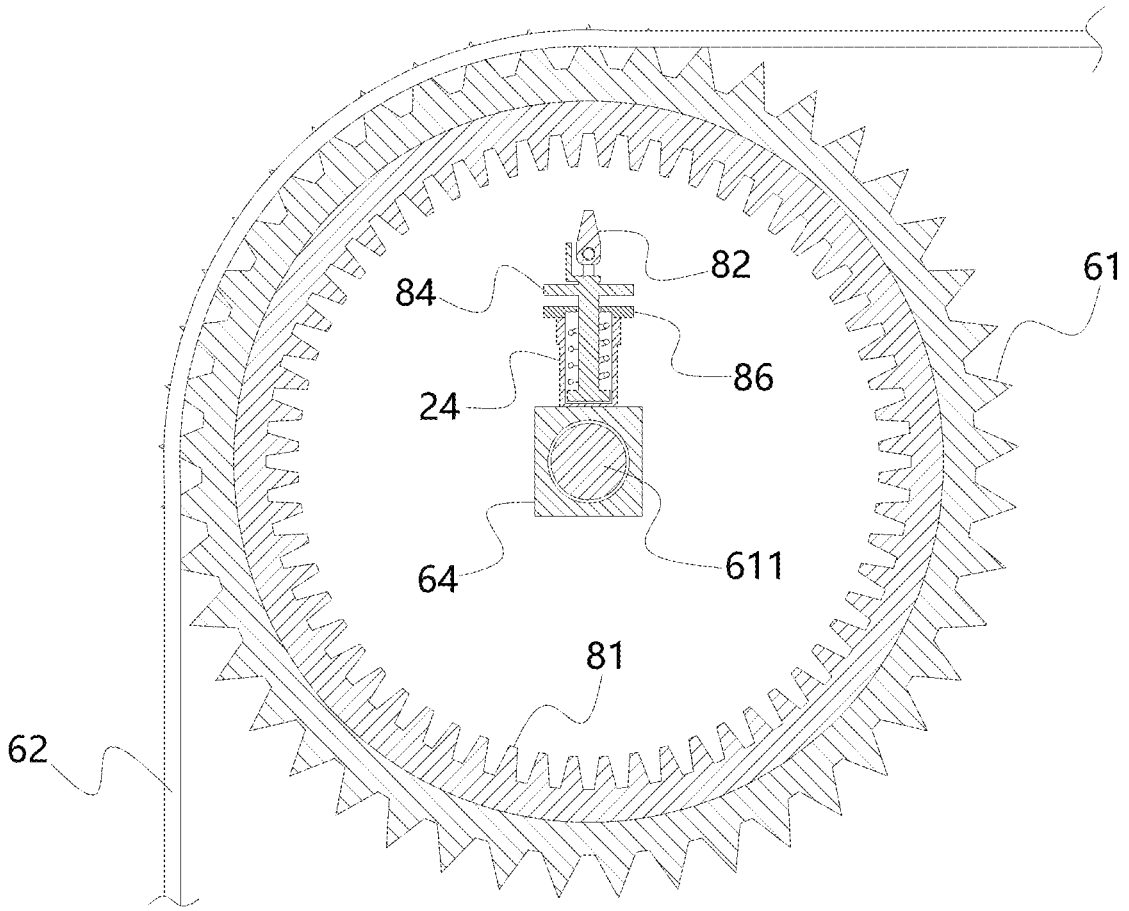
FIG. 5 is a schematic sectional view of structures near the sprocket of an emergency braking mechanism of a freely movable construction platform according to embodiments of the present disclosure, where the symbols for section are only used for distinguishing different elements and is without any other meaning.
Figure 6:
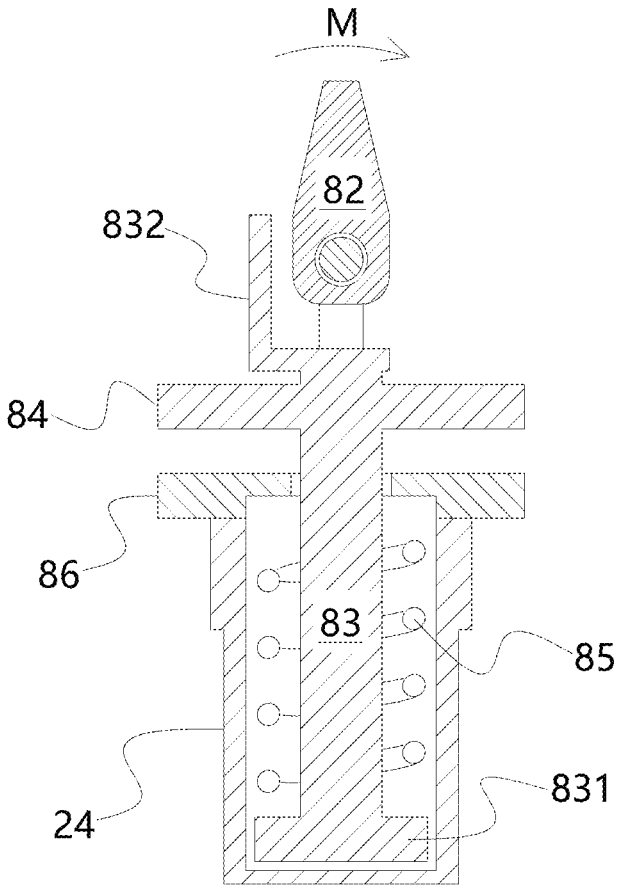
FIG. 6 is an enlarged view of FIG. 5 excluding the sprocket, the chain, the ring gear, the angle sensor and the rotating shaft of the sprocket.
Figure 7:
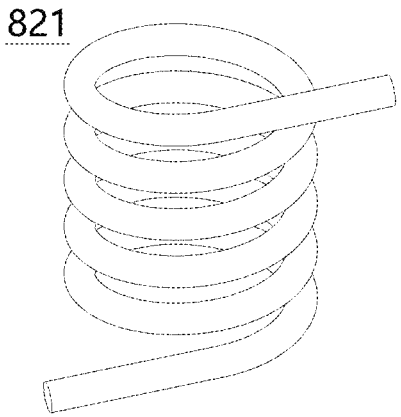
FIG. 7 is a schematic perspective view of a torsion spring of a configuring assembly of a freely movable construction platform according to embodiments of the present disclosure.

Exemplary, each mounting bracket 2 is provided with a mounting sleeve 24, as shown in FIGS. 5 and 6. The configuring rod 83 may be movably arranged on the mounting sleeve 24. The configuring rod 83 may be provided with a plate 831 which is configured to be pressed by the second spring 85, such that the configuring rod 83 and the pawl 82 can be driven by the elasticity of the second spring 85 to move away from the ring gear 81.

Exemplary, as shown in FIG. 5, the sprocket 61 and the ring gear 81 are connected with a shaft 611 which is connected to the mounting bracket 2 and servers as the rotating shaft of the sprocket 61 and the ring gear 81. The angle sensor 64 and the mounting sleeve 24 are generally fixedly connected with the mounting bracket 2.

When the ring-shaped platform formed by the curved platforms 1 is in the emergency braking state, the electromagnets 86 will be energized to be activated. Thus, the magnetic blocks 84 are repelled by the electromagnets 86; the magnetic blocks 84, the configuring rods 83 and the pawls 82 move towards and close to the ring gears 81. The pawls 82 enter between two teeth of the ring gears 81 and engage with the two teeth. The swing direction of the pawls 82 is unidirectional. As shown in FIG. 6, the pawls 82 can only swing in the direction M. The configuring rod 83 is provided with a block 832 which can prevent the pawl 82 from swing in the counter direction of the direction M. Cooperating with the torsion springs 821 which can cause the pawl 82 to reset to the position shown in FIGS. 5 and 6, a ratchet mechanism is formed. The pawl 82 is limited by the ratchet mechanism, such that the pawl 82 cannot swing in the counter direction of the direction M. Therefore, when the pawls 82 enters two teeth of the ring gears 81, the sprockets 61 can only rotate in the first direction (the clockwise direction in FIGS. 3 and 5), such that the counterweights 63 cannot pull the movable rods 51 through the chains 62 and the suction cups 5 can keep contacting and sucking the side wall of the cylindrical building 10 to prevent the ring-shaped platform formed by the curved platforms 1 from falling again.

When it is needed to dismiss the emergency braking state, the electromagnets 86 are unenergized and the magnetic blocks 84 are no longer repelled by the electromagnets 86. The configuring rods 83 and the pawls 82 move, driven by the second springs 85 which press the plates 831 arranged on the bottom end of the configuring rods 83, away from the ring gears 81. At this time, the sprockets 61 are no longer limited and can rotate freely, and the counterweights 63 thus can pull the suction cups 5 to move away from the cylindrical building 10 through the chains 62 simultaneously the sprockets 61 rotate in the counter direction (the counter clockwise direction in FIGS. 3 and 5) of the first direction. Thus, the emergency braking state is dismissed, the first springs 52 sleeved on the movable rods 51 are in compression, and the ring-shaped platform formed by the curved platforms 1 can freely move up and down driven by the drive wheels 23.

Embodiment 3

Embodiment 3 includes the structures of the Embodiment 1 and Embodiment 2. In Embodiment 3, please referring to FIG. 4, each pumping mechanism 7 provided by the present embodiment may include a pumping assembly 71 and a pipe 72. The pipe 72 is configured for communicating between the pumping assembly 71 and the suction cup 5. The pumping assembly 71 is electrically connected with the control panel.

Specifically, each pumping assembly 71 may be a pump with the function of both pumping air from the suction cup 5 and supplying air for the suction cup 5; the pumping assembly 71 also may be a pump system including a vacuum pump for pumping air, an inflatable pump for supplying air, and pipelines and valves for connecting and controlling the vacuum pump and the inflatable pump.

Figure 4:
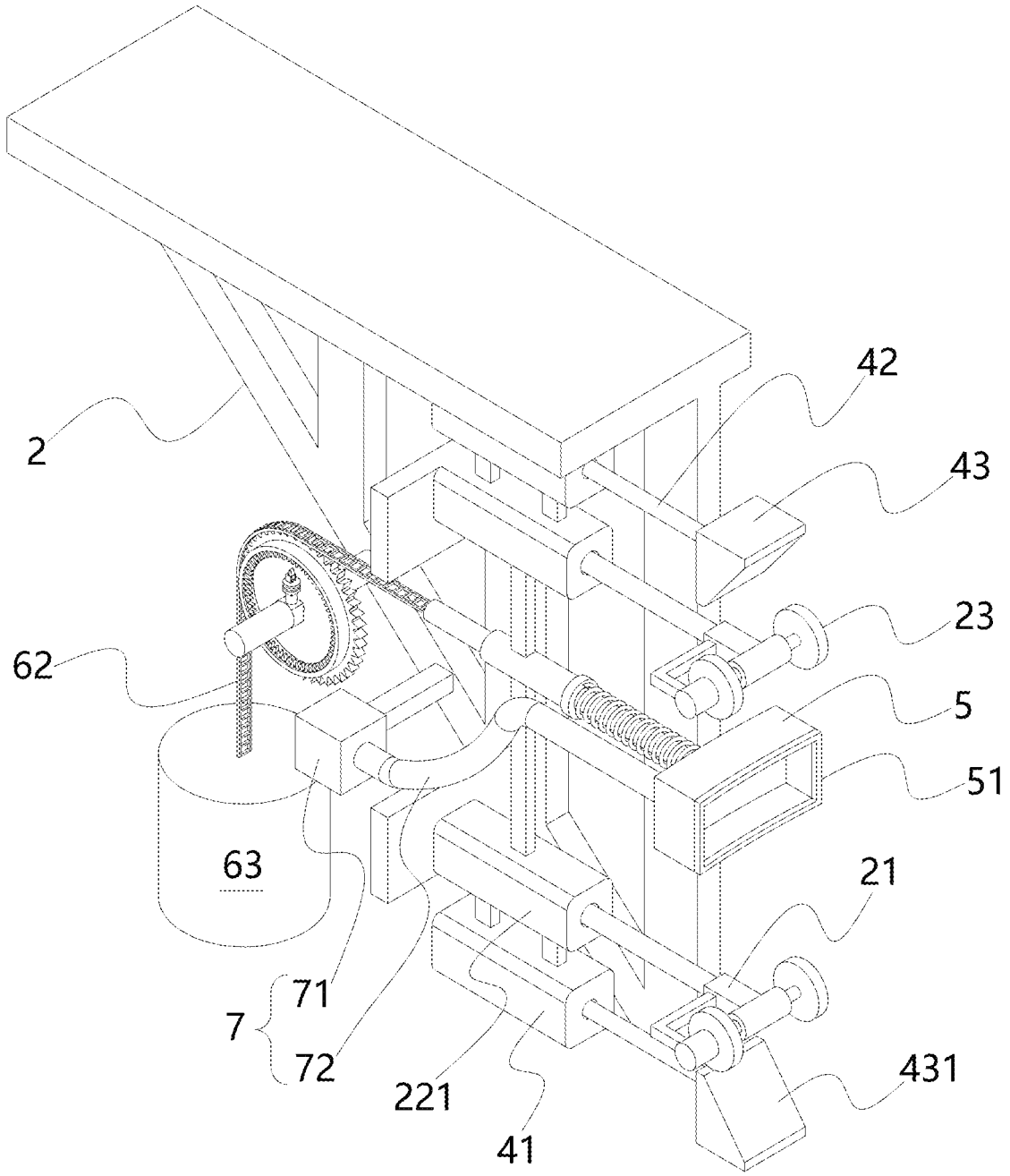
FIG. 4 is a schematic perspective view of structures shown in FIG. 3 excluding the curved platform and the cylindrical building.

Exemplary, please referring to FIGS. 3 and 4, each locking mechanisms 4 may include a first hydraulic cylinder 41, a piston rod 42, a movable block 43 and a guide block 44. The first hydraulic cylinder 41 is electrically connected with the control panel. The movable block 43 is arranged on the first end of the piston rod 42. The second end of the piston rod 42 is in the first hydraulic cylinder 41. The movable block 43 is provided with a first inclined plane 431. The guide block 44 is embedded in a limitation groove 45 that is arranged in the side wall of the cylindrical building 10, and the guide block 44 is provided with a second inclined plane 441 that is matched with the first inclined plane 431 of the movable block 43. When the piston rod 42 is driven by the first hydraulic cylinder 41 to move towards the side wall of the cylindrical building 10, the movable block 43 can enter the limitation groove 45 and is blocked by inners walls of the limitation groove 45, such that the movable block 43 is unmovable up and down and each mounting bracket 2 is locked in the height direction of the cylindrical building 10. At this time, the first inclined plane 431 of the movable block 43 and the second inclined 441 plane of the guide block 44 fit together.

As shown in FIGS. 1 and 3, several limitation grooves 45 with guide blocks 44 in them may be provided. Each limitation groove 45 with a guide block 44 corresponds to a height of the cylindrical building 10, which may be served as a work position for the inspection and maintenance of the cylindrical building 10. Each work position may be provided with several limitation grooves 45 and guide blocks 44. When the ring-shaped platform formed by the curved platforms 1 moves to a work position, the control panel controls the first hydraulic cylinders 41 to drive piston rods 42 and the movable blocks 43 arranged on the second ends of them to move towards the cylindrical building 10, thus the movable blocks 43 can enter the limitation grooves 45 and realize the locking of the ring-shaped platform formed by the curved platforms.

Exemplary, as shown in FIG. 3, each pressing mechanism 22 may include a second hydraulic cylinder 221 which is connected with a movable bracket 21 and is electrically connected with the control panel, such that the second hydraulic cylinder 221 (which is controlled by the control panel) can drive the drive wheels 23 arranged on the movable bracket 21 to press tightly on the side wall of the cylindrical building 10. When the drive wheels 23 are pressed on the side wall of the cylindrical building 10, they can drive the ring-shaped platform formed by the curved platforms 1 moving up and down.

Exemplary, please referring to FIG. 4, the outer edge of each suction cup 5 is provided with a rubber strip 51.

Using the rubber strip 51, the gap between the outer edge of the suction cup 5 and the side wall of the cylindrical building 10 can be better sealed, such that the vacuum cavity between the suction cup 5 and the side wall of the cylindrical building 10 can be better formed (through pumped by the pumping mechanism 7) and maintained.

Exemplary, as shown in FIG. 2, each curved platforms 1 is provided with one or more support rods 9. The first end of each support rod 9 is connected with the curved platform 1, and the second end of each support rod 9 is provided with a roller 91. The roller 91 is configured to contact and roll on the side wall of the cylindrical building 10. The support rods 9 are configured to laterally support the curved platform 1.

The support rods 9 laterally support the ring-shaped platform formed by the curved platforms 1 and the rollers 91 arranged on the second ends of the support rods 9 contact and roll on the side wall of the cylindrical building 10. This facilitates the smoothness of the moving up and down of the ring-shaped platform formed by the curved platforms.

The above descriptions are only preferred embodiments of the present disclosure, and are not intended to limit the present disclosure. Any modifications, equivalent replacements and improvements made within the spirit and principle of the present disclosure shall be included within the protection scope of the present disclosure.

The invention claimed is:

1. A construction platform comprising:

a plurality of curved platforms and a plurality of columns, wherein the plurality of columns are configured to be distributed in a manner of surrounding a cylindrical building, the plurality of curved platforms are connected to and movable along the plurality of columns, the plurality of curved platforms are connected to one after the other to form a ring-shaped platform that surrounds the cylindrical building and is movable along lengths of the plurality of columns, each curved platform of the plurality of curved platforms is provided with one or more mounting brackets, and each mounting bracket of the one or more mounting brackets is provided with:

one or more movable brackets, wherein each of the one or more movable brackets is provided with one or more drive wheels that are motor drivable;

one or more pressing mechanisms that are electrically controllable, wherein the one or more pressing mechanisms correspond one-to-one to the one or more movable brackets, and each of the one or more pressing mechanisms is configured to drive a corresponding movable bracket of the one or more movable brackets to move towards the cylindrical building, such that the one or more drive wheels that are arranged on the corresponding movable bracket are pressed against a side wall of the cylindrical building;

one or more locking mechanisms electrically controllable, wherein the one or more locking mechanisms are configured to lock the each mounting bracket to the cylindrical building;

one or more movable rods, wherein each movable rod of the one or more movable rods is sleeved with a first spring, a first end of the each movable rod is provided with a suction cup, and the first spring is configured to press the suction cup to contact the side wall of the cylindrical building;

a pumping mechanism in communication with the suction cup, wherein the pumping mechanism is configured to, when the suction cup contacts the side wall of the cylindrical building, pump air between the suction cup and the side wall of the cylindrical building, to form a vacuum cavity between the suction cup and the side wall of the cylindrical building such that the suction cup sucks and holds on the cylindrical building; and one or more emergency braking mechanisms, wherein the one or more emergency braking mechanisms correspond one-to-one to the one or more movable rods, and each of the one or more emergency braking mechanisms comprises:

a sprocket arranged on the each mounting bracket;

a chain that matches the sprocket, wherein a first end of the chain is connected to a second end of a corresponding movable rod of the one or more movable rods, a second end of the chain is connected to a counterweight, the counterweight is used in detecting whether the each curved platform is in a normal state or in an abnormal falling state, and wherein:

when the each curved platform is in the normal state, the counterweight is configured to pull the chain to drive, by a gravity of the counterweight, the corresponding movable rod and the suction cup that is arranged on the corresponding movable rod to move away from the side wall of the cylindrical building; and when the each curved platform is in the abnormal falling state, under an action of inertia of the counterweight, the suction cup arranged on the corresponding movable rod is pressed by the first spring sleeved on the corresponding movable rod to contact the side wall of the cylindrical building to form the vacuum cavity between the suction cup arranged on the corresponding movable rod and the side wall of the cylindrical building;

an angle sensor, wherein the angle sensor is connected to the sprocket and is configured to detect a rotating direction of the sprocket and a rotating angle of the sprocket; and a configuring assembly for configuring the rotating direction of the sprocket, comprising:

a ring gear that is fixedly arranged on the sprocket and is coaxial with the sprocket;

a mounting sleeve arranged on the each mounting bracket;

a configuring rod that is movable, wherein the configuring rod is sleeved with a second spring, a first end of the configuring rod is provided with a plate pressable by the second spring, both the plate and the second spring are arranged in the mounting sleeve, the second spring is connected to the mounting sleeve, and a first end of the second spring is configured to contact and press the plate;

a pawl arranged on a second end of the configuring rod, wherein the pawl is configured to unidirectionally swing;

a torsion spring connected between the pawl and the second end of the configuring rod, wherein the torsion spring is configured to cause the pawl to reset to a position at which the pawl is insertable between two teeth of the ring gear;

an electromagnet arranged on the mounting sleeve and electrically controllable; and a magnetic block arranged on the configuring rod and adjacent to the electromagnet; and wherein:

when the each curved platform is in the normal state, the second spring is configured to press the plate arranged on the first end of the configuring rod to drive the configuring rod and the pawl arranged on the second end of the configuring rod to move away from the ring gear, such that the rotating direction of the sprocket is not limited; and when the each curved platform is in the abnormal falling state, the electromagnet is configured to be activated to repel the magnetic block, such that the configuring rod and the pawl arranged on the second end of the configuring rod are driven to move towards the ring gear, the pawl enters between two teeth of the ring gear, and the sprocket is prevented from rotating in a direction that leads the corresponding movable rod and the suction cup that is arranged on the corresponding movable rod to move away from the side wall of the cylindrical building.

2. The construction platform of claim 1, wherein the pumping mechanism comprises:

a pumping assembly that is electrically controllable; and a pipe for communication between the pumping assembly and the suction cup.

3. The construction platform of claim 1, wherein each of the one or more locking mechanisms comprises:

a first hydraulic cylinder that is electrically controllable, wherein the first hydraulic cylinder is provided with a piston rod;

a movable block arranged on a first end of the piston rod, wherein the movable block is provided with a first inclined plane; and a guide block embedded in a limitation groove that is arranged in the side wall of the cylindrical building, wherein the guide block is provided with a second inclined plane that matches the first inclined plane; and wherein:

when the piston rod is driven by the first hydraulic cylinder to move towards the side wall of the cylindrical building, the movable block enters the limitation groove and is blocked by inner walls of the limitation groove, such that the movable block is unmovable up and down and the each mounting bracket is locked to the cylindrical building; and when the movable block enters the limitation groove, the first inclined plane of the movable block contacts the second inclined plane of the guide block.

4. The construction platform of claim 1, wherein each of the one or more pressing mechanisms comprises a second hydraulic cylinder that is electrically controllable, the second hydraulic cylinder is connected to the corresponding movable bracket to drive the corresponding movable bracket to move towards and press the cylindrical building.

5. The construction platform of claim 1, wherein an outer edge of the suction cup is provided with a rubber strip.

6. The construction platform of claim 1, wherein the each curved platform of the plurality of curved platforms is further provided with one or more support rods, wherein a first end of each support rod of the one or more support rods is connected to the each curved platform, a second end of the each support rod is provided with a roller, the roller is configured to contact the side wall of the cylindrical building, and the each support rod is configured to laterally support the each curved platform.

* * * * *